US006409608B1

(12) United States Patent
Garske

(10) Patent No.: US 6,409,608 B1
(45) Date of Patent: Jun. 25, 2002

(54) GOLF CUP SLEEVE

(75) Inventor: Stephen J. Garske, Little Canada, MN (US)

(73) Assignee: Par Aide Products Co., St. Paul, MN (US)

( * ) Notice: Subject to any disclaimer, the term of this patent is extended or adjusted under 35 U.S.C. 154(b) by 0 days.

(21) Appl. No.: 09/369,529

(22) Filed: Aug. 6, 1999

(51) Int. Cl.[7] ..... A63B 57/00
(52) U.S. Cl. ..... 473/175
(58) Field of Search ..... 473/174–177, 473/179

(56) References Cited

U.S. PATENT DOCUMENTS

| | | | | | |
|---|---|---|---|---|---|
| 2,457,759 | A | * | 12/1948 | Wales | 473/175 |
| 3,612,534 | A | | 10/1971 | Browne | 273/134 CG |
| 3,643,944 | A | * | 2/1972 | Boyes | 473/175 |
| 4,900,023 | A | | 2/1990 | Gelina | 273/34 |
| 5,029,856 | A | * | 7/1991 | Bookspan | 473/175 |
| 5,180,162 | A | | 1/1993 | Browne | 273/34 R |
| 5,190,283 | A | * | 3/1993 | Hannon | 473/175 |
| 5,316,292 | A | | 5/1994 | Browne | 273/34 R |
| 5,362,044 | A | * | 11/1994 | Hageman | 473/175 |
| 5,382,018 | A | | 1/1995 | Browne | 273/34 R |
| 5,415,397 | A | * | 5/1995 | Van Holt, Jr. | 473/179 |
| 5,971,863 | A | * | 10/1999 | Durso | 473/180 |

FOREIGN PATENT DOCUMENTS

| | | | |
|---|---|---|---|
| GB | 355171 | 8/1931 | |
| GB | 381096 | 9/1932 | |
| GB | 2206804 | 1/1989 | |
| GB | 2221556 | 2/1990 | |
| WO | 97/15357 | 5/1997 | ..... A63B/57/00 |

OTHER PUBLICATIONS

*American Eagle Golf Course Accessories Catalog*, 1, 15, (1994).

"Come–Putts", *Bolsa Supply Company*, Oak Park, ILL., p. 35, (Circa 1931).

"Napex Golf—Featuring the Best Selection of Golf Cups Available", undated brochure from Napex Golf, Auburn, PA 17922; 6 pages. (This reference was known to Applicant prior to Aug. 6, 1999, the filing date of the above–identified application SN 09/369,529).

* cited by examiner

*Primary Examiner*—Mark S. Graham
(74) *Attorney, Agent, or Firm*—Schwegman, Lundberg, Woessner & Kluth, P.A.

(57) ABSTRACT

A metal golf cup of a cylindrical shape includes a severable, plastic sleeve disposed therein. The plastic sleeve has a conical shape couples with the golf cup in an interference fit. The sleeve further includes a top sleeve portion at a top surface of the sleeve, and the top sleeve portion rests on a top surface of the metal golf cup.

13 Claims, 6 Drawing Sheets

GOLF CUP SLEEVE

FIELD OF THE INVENTION

The present invention relates generally to golf cups. More particularly, it pertains to a sleeve for a golf cup.

BACKGROUND OF THE INVENTION

In preparing a golf green, a hole is cored into the ground which receives the golf ball therein. Various cups have been inserted into the ground to preserve the shape of the hold and to hold a flag. One example of a cup inserted into the hole is a plastic cup. The plastic cup has several drawbacks, however. For instance, the plastic cup cracks and/or discolors and must be changed regularly during the golfing season. To see the golf cup, the plastic cup is created in white which allows for clear visibility. However, the white plastic becomes dirty easily and must be changed to provide a fresh appearance for the course. To change the cup, the entire cup is removed from the ground, and generally a new hole must be cored into the ground.

An alternative to providing a plastic cup with a shorter life, is to provide a metal golf cup. The metal golf cup resists cracking. To provide visibility, the interior of the golf cup is painted white. However, as golf ball strike the interior of the golf cup, the paint chips from the interior surface. This problem is exacerbated as golfers strike the wall of the cup while inserting or removing the flag, or while using a club to remove a ball from the cup. To update the painted interior surface of the metal golf cup, the golf cup is removed from the ground and the interior surface is re-painted, which is labor intensive.

Accordingly, what is needed is a cost effective manner to refresh the interior surface of a golf cup.

SUMMARY OF THE INVENTION

A golf cup apparatus includes a golf cup comprising a cylinder which extends from a top surface to a bottom surface. In one embodiment, the golf cup is formed of metal. The golf cup is defined in part by a wall having an interior surface and an exterior surface, where the wall extends from a top surface to a bottom surface. In yet another embodiment is a ridge is formed on the interior surface of the cup to retain a sleeve therein.

Disposed within the golf cup is a cup sleeve, which has a cylindrical shape and abuts the wall of the golf cup. The sleeve, in one embodiment, extends from top surface of the golf cup to the bottom surface of the golf cup, and can be coupled with the golf cup. In another embodiment, the sleeve extends partially between the top surface and the bottom surface of the golf cup, where, optionally, a top portion of the sleeve is substantially aligned with the top surface of the golf cup.

The sleeve is formed of a molded or extruded plastic material, where the sleeve is severable, and thereby removable from the golf cup. In one embodiment, the sleeve includes a line of weakness and/or a notch. In another embodiment, a top sleeve is coupled with a top portion of the cup sleeve, and the top sleeve disposed above the golf cup. In yet another embodiment, the sleeve has a conical shape where a first end has a larger diameter than a second end.

In another embodiment, a golf cup apparatus includes a metal golf cup including flag retention features therein and comprising a cylinder which extends from a top surface to a bottom surface. The golf cup is defined in part by a wall having an interior surface and an exterior surface, where the wall extends from a top surface to a bottom surface. The metal golf cup includes sleeve retention features which comprise an annular ridge formed on the interior surface of the cup.

Disposed within the golf cup is a cup sleeve, which has a cylindrical shape and abuts the wall of the golf cup. The sleeve, in one embodiment, extends from top surface of the golf cup to the bottom surface of the golf cup, and is coupled with the golf cup.

The sleeve is formed of a molded or extruded plastic material, where the sleeve is severable, and thereby removable from the golf cup. In one embodiment, a top sleeve is coupled with a top portion of the cup sleeve, and the top sleeve disposed above the golf cup. In yet another embodiment, the sleeve has a conical shape where a first end has a larger diameter than a second end.

In yet another embodiment, a method is discussed for refreshing a golf cup having a first cup sleeve therein, the first cup sleeve including a severable cup sleeve disposed within the golf cup, the severable cup sleeve comprising a plastic cylinder defined in part by an outer surface, the plastic cylinder disposed within the golf cup such that the outer surface of the plastic cylinder rests against an interior surface of the golf cup in an interference fit, the severable cup sleeve extending from a first end to a second end, the first end disposed at the top surface of the golf cup, and the second end disposed at the bottom surface of the golf cup. The method for refreshing includes removing the first cup sleeve from the golf cup, wherein the first cup is removed by severing at least a portion of the first cup sleeve. A second cup sleeve is inserted into the golf cup, where the second cup sleeve having a tapered cylindrical shape.

Advantageously, the plastic sleeve allows for the interior surface of the metal golf cup to be maintained in a fresh condition, for instance, of a white color with minimal ball marks. When the plastic sleeve becomes marred or discolored, the sleeve is severed and easily removed. A new sleeve is installed in the golf cup, and the interior surface of the golf cup has a neat and clean appearance. Maintenance of the plastic sleeve is not labor intensive, and is an inexpensive alternative to painting the interior surface of the metal golf cup. In addition, the conical shape of the cup sleeve aids in installation of the cup sleeve within the golf cup. The conical shape allows for the sleeves to be stacked more compactly for shipping.

These and other embodiments, aspects, advantages, and features of the present invention will be set forth in part in the description which follows, and in part will become apparent to those skilled in the art by reference to the following description of the invention and referenced drawings or by practice of the invention. The aspects, advantages, and features of the invention are realized and attained by means of the instrumentalities, procedures, and combinations particularly pointed out in the appended claims and their equivalents.

DESCRIPTION OF THE EMBODIMENTS

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural changes may be made without departing from the scope of the present invention. Therefore, the following detailed description is not to be taken in a limiting sense, and the scope of the present invention is defined by the appended claims and their equivalents.

Figure 1A:
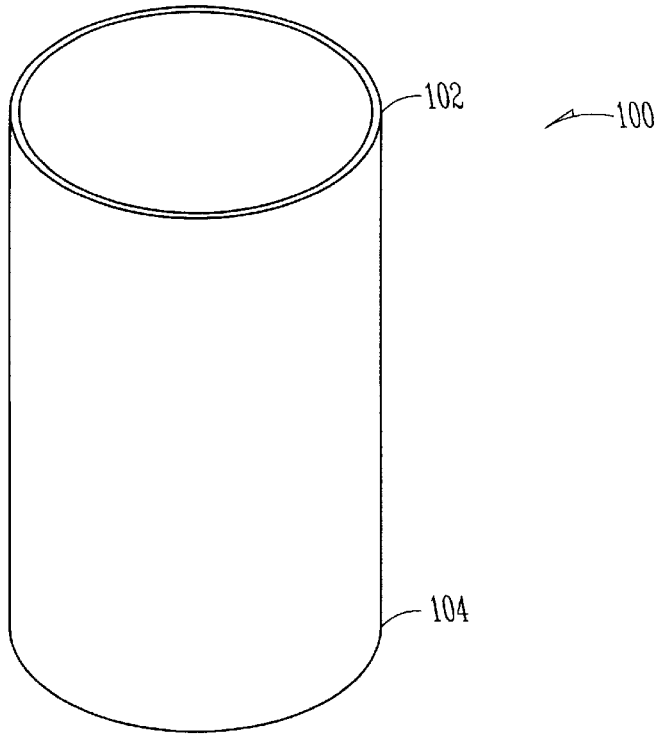
FIG. 1A is a perspective view illustrating a golf cup sleeve constructed in accordance with one embodiment of the present invention.
Figure 1B:
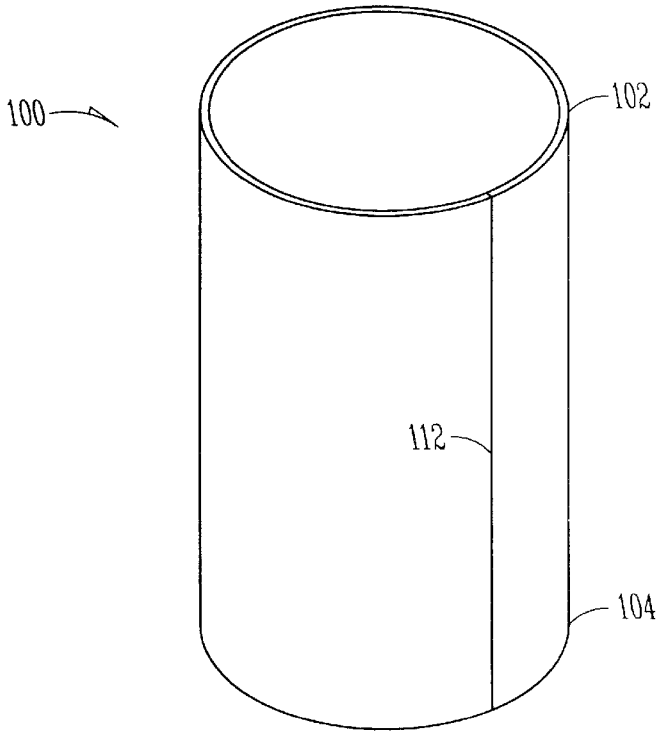
FIG. 1B is a perspective view illustrating a golf cup sleeve constructed in accordance with one embodiment of the present invention.
Figure 1C:
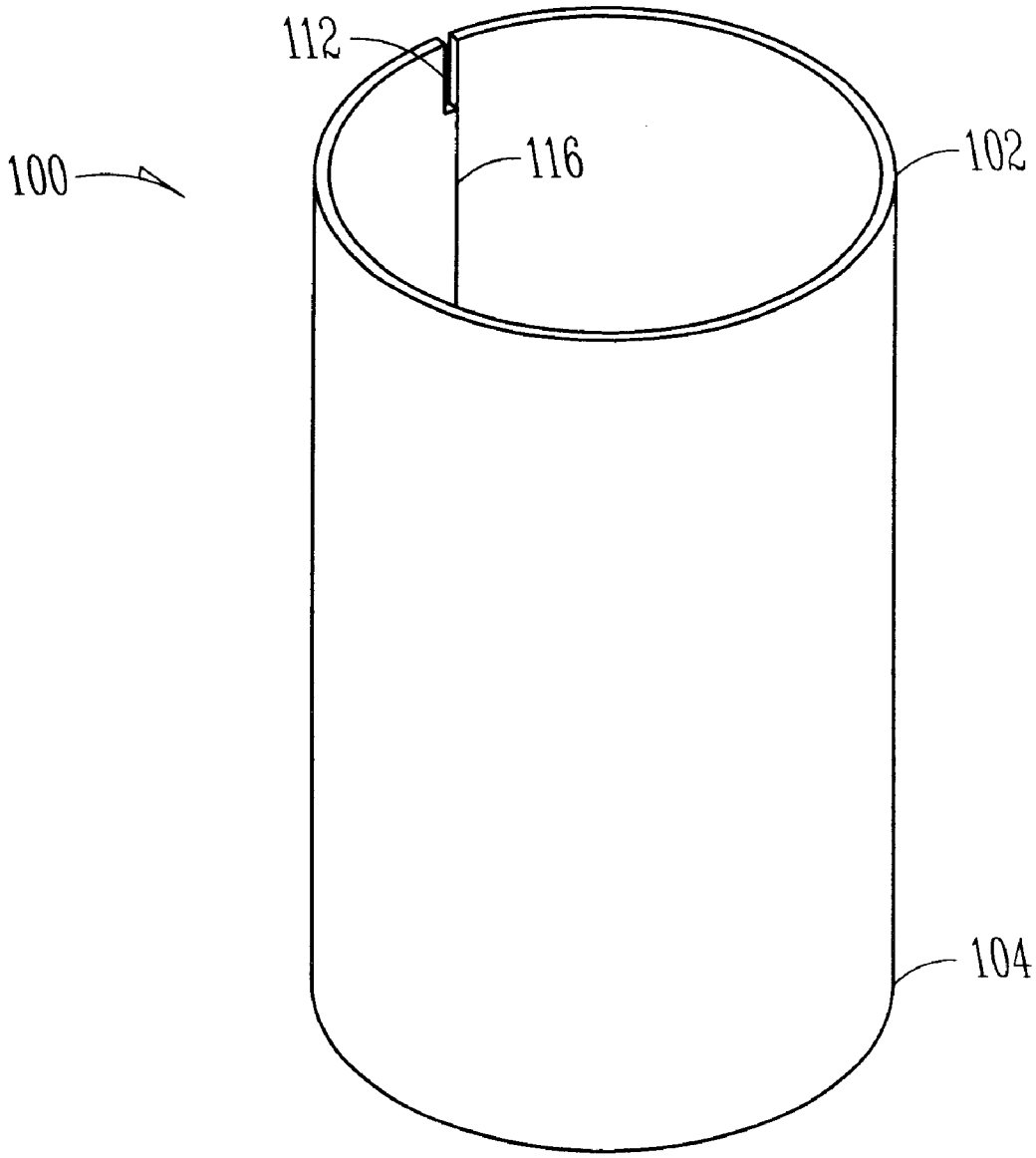
FIG. 1C is a perspective view illustrating a golf cup sleeve constructed in accordance with one embodiment of the present invention.

A cup sleeve is shown in FIGS. 1A–1C, and includes a replaceable sleeve for a golf cup (See FIGS. 2, 3, 4, and 6). In one embodiment, the cup sleeve 100 extends from a first end 102 to a second end 104, and comprises a cylinder. In another embodiment, as shown in FIG. 2B, the cup sleeve 100 comprises a conical shape, such that a diameter at the first end 102 is larger than a diameter at the second end 104. The cup sleeve 100 is formed of a plastic material, for instance, of an extrusion process. Alternatively, the cup sleeve 100 can be formed of other materials and/or processes, such as molding.

Figure 2A:
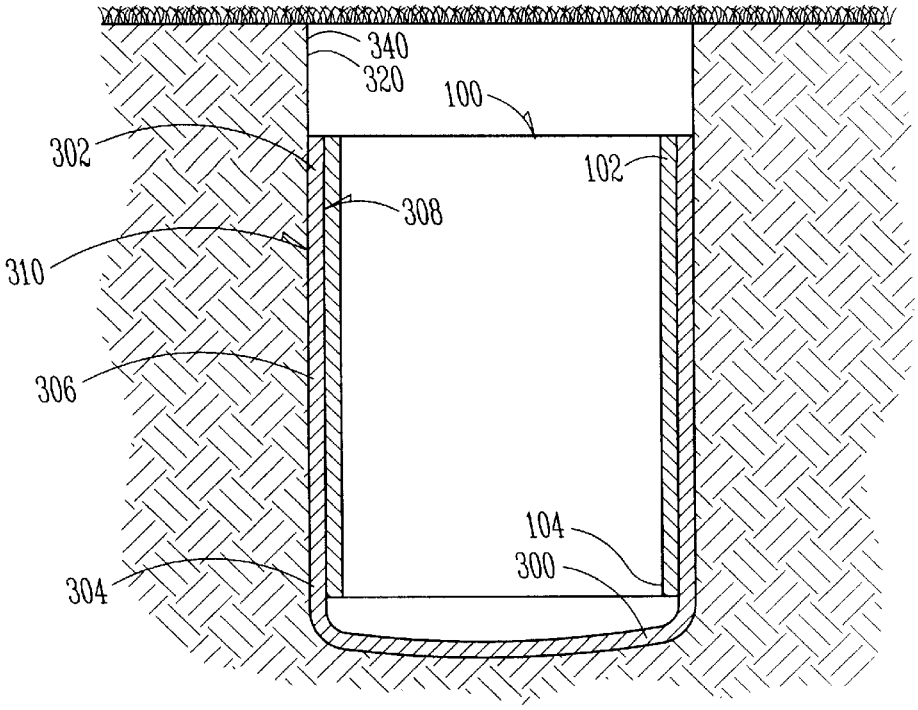
FIG. 2A is a cross-section view illustrating a golf cup apparatus constructed in accordance with one embodiment of the present invention.

In yet another embodiment, the cup sleeve 100 is adapted to be severable. The cup sleeve 100 is severable in a number of manners, such as, but not limited to, the cup sleeve 100 having a line of weakness 112, as shown in FIG. 1B. The line of weakness provides a weakened section of the sleeve 100 which allows the sleeve 100 to be severable, for example, without having to sever the entire sleeve with a cutting tool. In one embodiment, the line of weakness 112 extends from the top surface 102 to the bottom surface 104. Alternatively, the line of weakness 112 can extend partially between the top surface 102 and the bottom surface 104. In another embodiment, as shown in FIG. 1C, the cup sleeve 100 includes a notch 112. The notch 112 allows for a tool, such as a screwdriver, to be inserted therein. The tool is twisted or rotated to split at least a portion of the cup sleeve 100 so that it is easily removable from the golf cup, as further discussed below. Optionally, the cup sleeve 100 includes a notch 112 and a line of weakness 116. As mentioned above, the cup sleeve 100 is for use with a golf cup 300 (FIG. 2A). The cup sleeve 100, in another embodiment, further comprises a top sleeve as further discussed below.

Figure 2B:
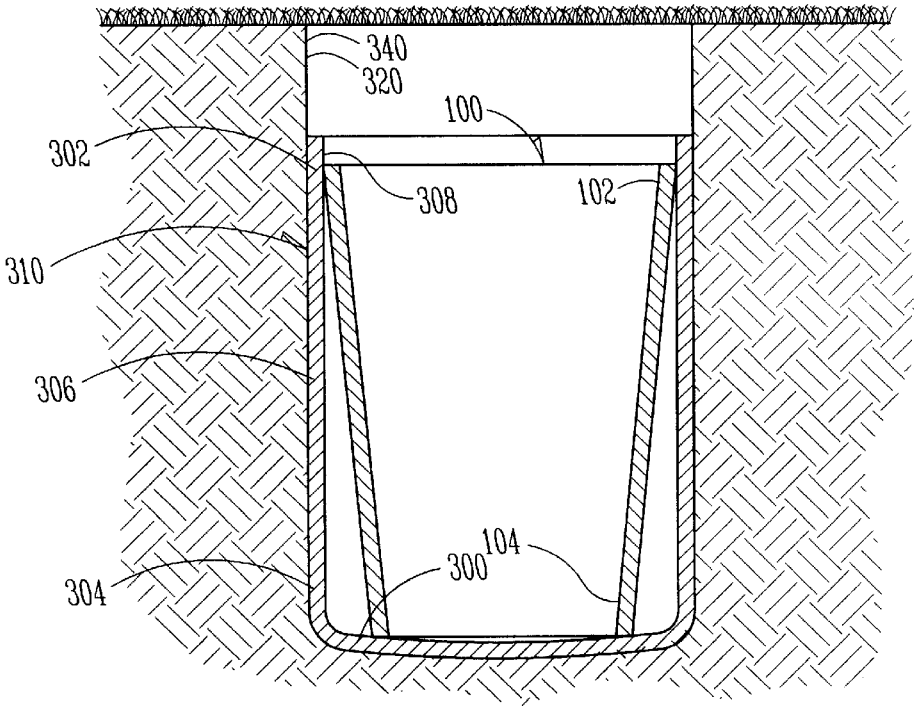
FIG. 2B is a cross-section view illustrating a golf cup apparatus constructed in accordance with one embodiment of the present invention.
Figure 3:
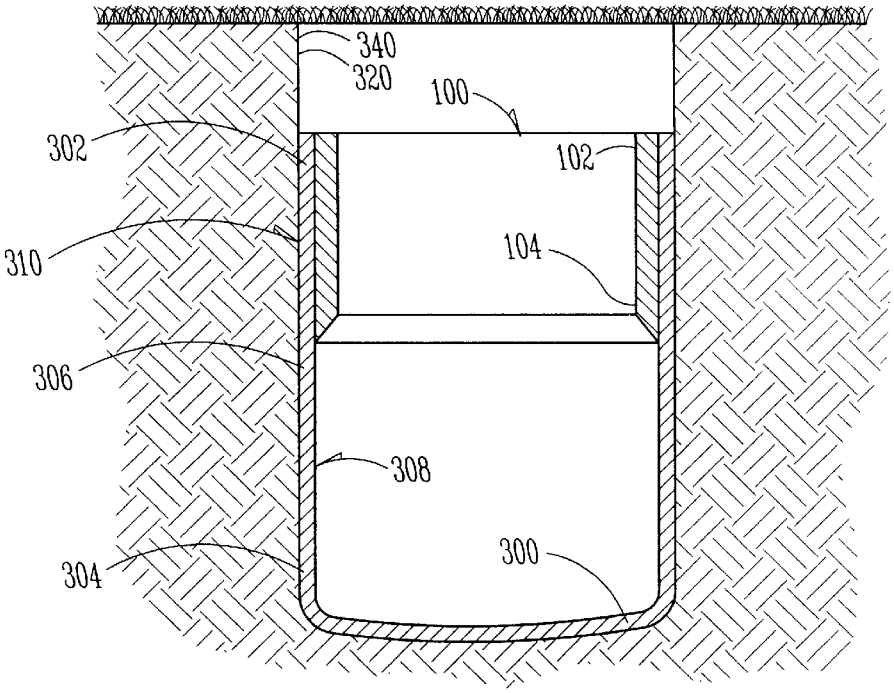
FIG. 3 is a cross-section view illustrating a golf cup apparatus constructed in accordance with one embodiment of the present invention.

As shown in FIGS. 2A, 2B, and 3, the golf cup 300, in one embodiment, is similar to conventional golf cups and comprises a generally cylindrical structure which fits within a hole 340 in the ground. The golf cup 300 is installed within the hole 340 of the ground such that a portion of earth 320 is disposed above the golf cup 300, as further discussed below. The golf cup 300 extends from a top end 302 to a bottom end 304, and having an intermediate portion 306 therebetween. The golf cup 300, in one embodiment is a metal golf cup, and is defined by an interior surface 308 and an exterior surface 310. When disposed within the hole 340, the exterior surface 310 of the golf cup 300 is adjacent to a wall of the hole 340.

The cup sleeve 100 is disposed within the golf cup 300. In one embodiment, as shown in FIG. 2A, the cup sleeve 100 extends from the top end 302 to the bottom end 304 of the golf cup 300 such that the first end 102 of the cup sleeve 100 is adjacent to the top end 302 and the second end 104 is adjacent to the bottom end 304. The cup sleeve 100, when installed within the golf cup 300, is adjacent to the interior surface 308 of the golf cup 300. As shown in FIG. 2B, in another embodiment, the cup sleeve 100 has a tapered, conical shape.

In another embodiment, the cup sleeve 100 partially extends between the top end 302 and the bottom end 304 of the golf cup 300 such that the cup sleeve 100 is disposed at an intermediate portion 306 of the golf cup 300. In yet another embodiment, the first end 102 of the cup sleeve 100 is aligned with the top end 302 of the golf cup 300, and the cup sleeve 100 partially extends between the top end 302 and the bottom end 304, as shown in FIG. 3.

Figure 4:
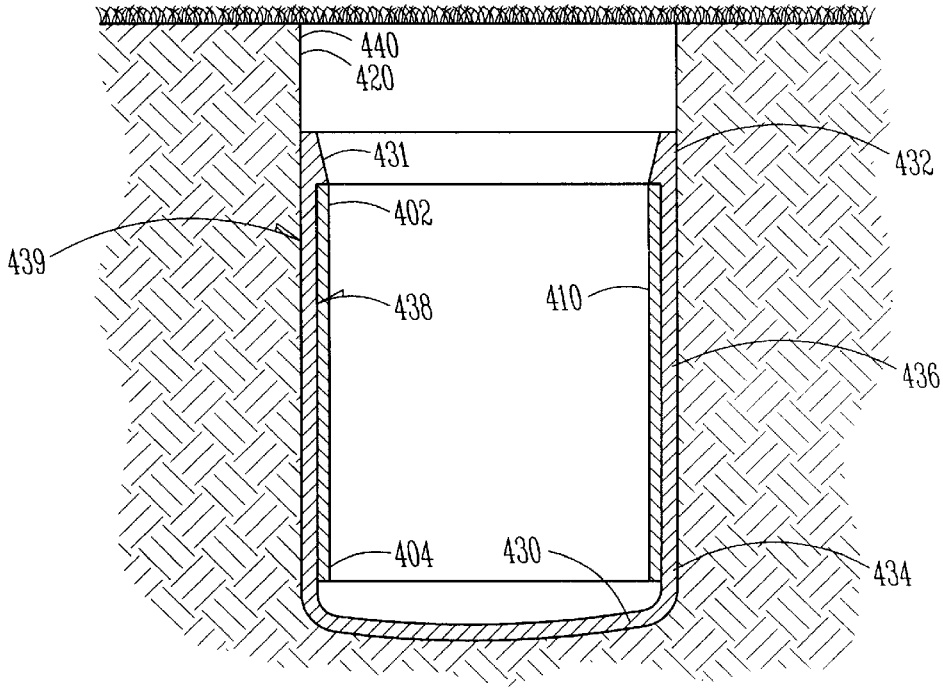
FIG. 4 is a cross-section view illustrating a golf cup apparatus constructed in accordance with one embodiment of the present invention.

FIG. 4 illustrates yet another embodiment of a golf cup apparatus 400. The golf cup apparatus includes a cup sleeve 410 and a golf cup 430. The cup sleeve 410 includes a replaceable sleeve which extends from a first end 402 to a second end 404, and comprises a cylinder. The cup sleeve 410 is replaceable, for example, as it is severable, as discussed above. In another embodiment, the cup sleeve 400 comprises a conical shape, such that a diameter at the first end 402 is larger than a diameter at the second end 404 (See FIG. 2B). The cup sleeve 400 is formed of a plastic material, for instance, of an extrusion process. Alternatively, the cup sleeve 400 can be formed of other materials and/or processes, such as molding. In yet another embodiment, the cup sleeve 400 is adapted to be severable, as discussed above.

The golf cup 430 is installed within a hole 440 of the ground such that a portion of earth 420 is disposed above the golf cup 430. The golf cup 430 extends from a top end 432 to a bottom end 434, and having an intermediate portion 436 therebetween. The golf cup 430, in one embodiment is a metal golf cup, and is defined by an interior surface 438 and an exterior surface 439. When disposed within the hole 440, the exterior surface 439 of the golf cup 430 is adjacent to a wall of the hole 440. Adjacent to the top end 432 of golf cup 430 includes a ridge 431. In one embodiment, the ridge 431 is an annular ridge and extends completely around the interior surface 438 of the golf cup 430. In another embodiment, the ridge 431 extends partially around the interior surface 438 of the golf cup 430. In yet another embodiment, a plurality of ridges are provided. The ridge 431 provides an extension which is adapted to retain the cup sleeve 410 within the golf cup 430.

The cup sleeve 410 is disposed within the golf cup 430. The cup sleeve 410 extends from the top end 432 to the bottom end 434 of the golf cup 430 such that the first end 402 of the cup sleeve 410 is adjacent to the top end 432 and the second end 404 is adjacent to the bottom end 434. The cup sleeve 410, when installed within the golf cup 430, is adjacent to the interior surface 438 of the golf cup 430.

Figure 5:
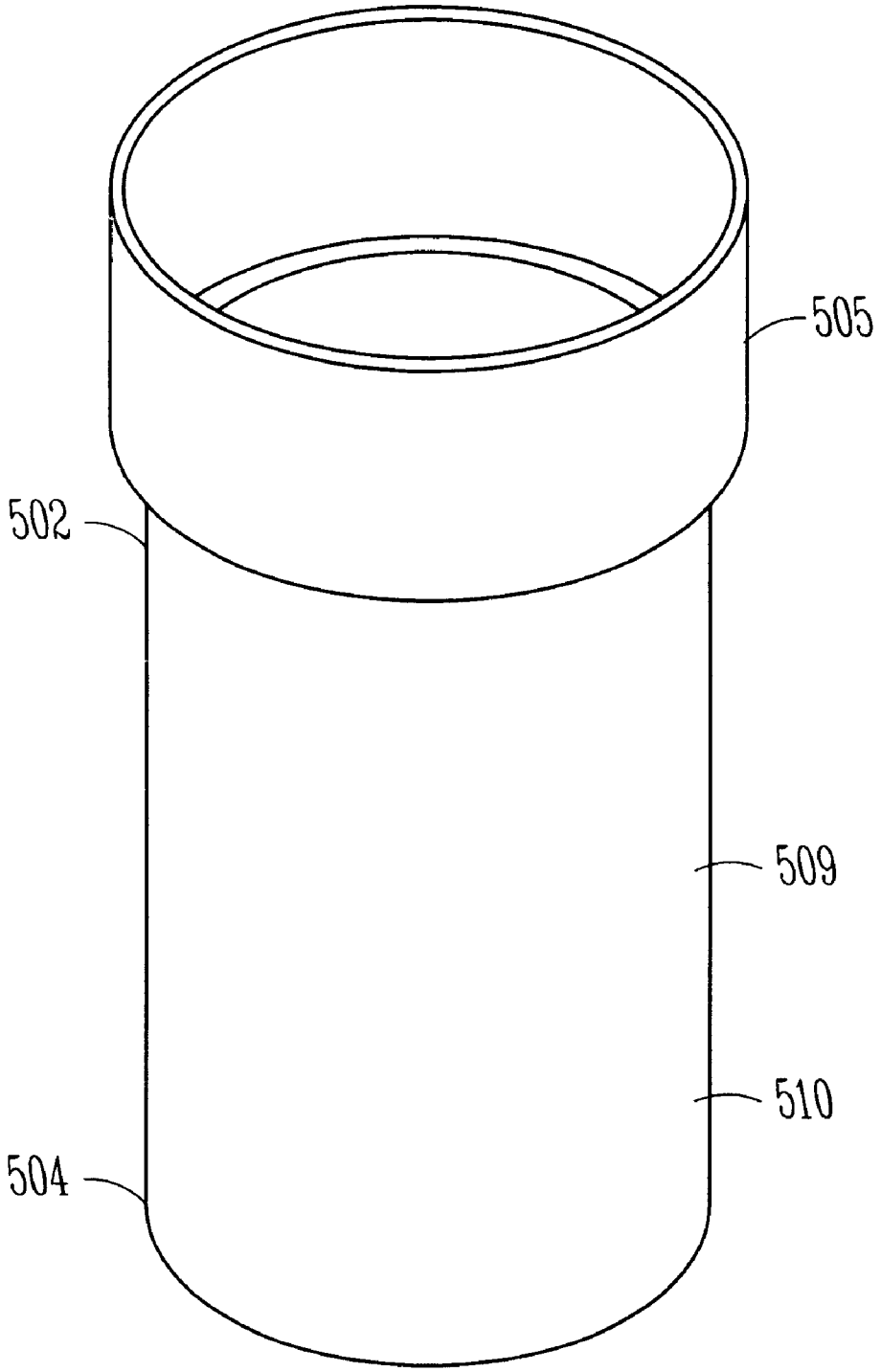
FIG. 5 is a perspective view illustrating a golf cup sleeve constructed in accordance with one embodiment of the present invention.
Figure 6:
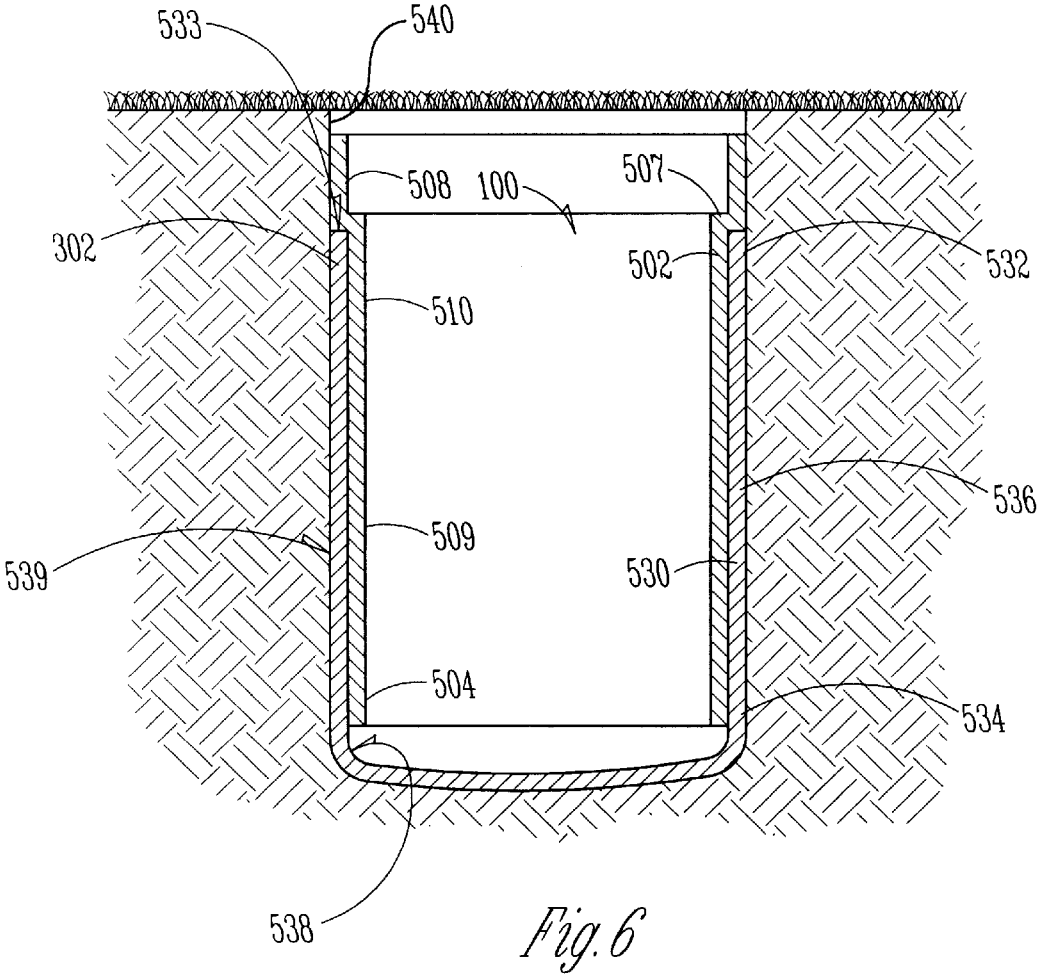
FIG. 6 is a cross-section view illustrating a golf cup apparatus constructed in accordance with one embodiment of the present invention.

FIGS. 5 and 6 illustrate yet another embodiment of a golf cup apparatus 500. The golf cup apparatus 500 includes a cup sleeve 510 and a golf cup 530. The cup sleeve 510 includes a first sleeve portion 509 which extends from a first end 502 to a second end 504, and comprises a cylinder. The cup sleeve 510 is replaceable, for example, as it is severable, as discussed above. In another embodiment, the cup sleeve 500 comprises a conical shape, such that a diameter at the first end 502 is larger than a diameter at the second end 504. The cup sleeve 500 is formed of a plastic material, for instance, of an extrusion process. Alternatively, the cup sleeve 500 can be formed of other materials and/or processes, such as molding.

The cup sleeve 500 further includes a top sleeve 505, forming a second sleeve portion 508. The top sleeve 505 is coupled at the first end 502 of the first sleeve portion 509. The top sleeve 505 has a cylindrical shape and has a larger diameter than the first sleeve portion 509, as shown in FIG. 6. The top sleeve 505, in one embodiment, is severable along with the first sleeve portion 509. In one embodiment, a transition portion 507 is disposed between the top sleeve 505 and the first sleeve portion 509. The transition portion 507, in one embodiment, is disposed transverse to the first sleeve portion 509. In another embodiment, the transition portion 507 is tapered between the first sleeve portion 509 and the second sleeve portion 508.

The golf cup 530 is installed within a hole 540 of the ground such that a portion of earth 520 is disposed above the golf cup 530. The golf cup 530 extends from a top end 532 to a bottom end 534, and having an intermediate portion 536 therebetween. The golf cup 530, in one embodiment is a metal golf cup, and is defined by an interior surface 538 and an exterior surface 539. When disposed within the hole 540, the exterior surface 539 of the golf cup 530 is adjacent to a wall of the hole 540. Adjacent to the top end 532 of golf cup 530 is a top surface 533 of the golf cup 530. In one embodiment, the top surface 533 is disposed transverse to the exterior surface 539. In another embodiment, the top surface 533 is tapered.

The cup sleeve 510 is disposed within the golf cup 530 such that the first sleeve portion 509 is disposed within the golf cup 530 and the second sleeve portion 508 is disposed adjacent to the top surface 533 of the golf cup 530. The second sleeve portion 508 extends away from the top surface 533 of the golf cup 530 and away from the first sleeve portion 509. The first sleeve portion 509 extends from the top end 532 to the bottom end 534 of the golf cup 530 such that the first end 502 of the first sleeve portion 509 is adjacent to the top end 532 and the second end 504 is adjacent to the bottom end 534. Optionally, the cup sleeve 510 and or the golf cup 530 further include sleeve retention features, such as those discussed and shown above.

The golf cup is refreshed, for example, by conducting the following steps. The cup sleeve is removed from the golf cup, for example, by severing the cup sleeve and lifting the cup sleeve from the golf cup. A new cup sleeve is placed into the golf cup and forced therein. In one embodiment, the cup sleeve is forced until the cup sleeve is placed into an interference fit within the golf cup. In another embodiment, the cup sleeve is forced until the cup sleeve snap-fits with mating features of the golf cup. It should be noted, however, that the mating features could be reversed between the cup sleeve and the golf cup, and are not limited to the embodiments discussed above. It should also be noted that features from a particular embodiment can be interchanged with those of other discussed embodiments, and are considered within the scope of the invention.

Advantageously, the plastic sleeve allows for the interior surface of the metal golf cup to be maintained in a fresh condition, for instance, of a white color with minimal ball marks. When the plastic sleeve becomes marred or discolored, the sleeve is severed and easily removed. A new sleeve is installed in the golf cup, and the interior surface of the golf cup has a neat and clean appearance. Maintenance of the plastic sleeve is not labor intensive, and is an inexpensive alternative to painting the interior surface of the metal golf cup. In addition, the conical shape of the cup sleeve aids in installation of the cup sleeve within the golf cup. The conical shape allows for the sleeves to be stacked more compactly for shipping.

It is to be understood that the above description is intended to be illustrative, and not restrictive. Many other embodiments will be apparent to those of skill in the art upon reading and understanding the above description. The scope of the invention should, therefore, be determined with reference to the appended claims, along with the full scope of equivalents to which such claims are entitled.

What is claimed:

1. A golf cup apparatus comprising:

a golf cup comprising a cylinder extending from a top surface to a bottom surface, the golf cup including a wall extending between the top surface and the bottom surface, the cup wall defined by an interior surface and an exterior surface;

a cup sleeve disposed within the golf cup, the sleeve comprising a cylinder having an open circular top end and an open circular bottom end and the cup sleeve abutting the interior surface of the golf cup without interfering with a golf ball dropping within the golf cup; and the sleeve includes a line of weakness; and wherein the cup sleeve extends from a first end to a second end and the line of weakness extends from the first end to the second end of the cup sleeve.

2. The golf cup apparatus as recited in claim 1, wherein the cup sleeve has a notch disposed therein.

3. The golf cup apparatus as recited in claim 1, wherein the golf cup is formed of metal.

4. The golf cup apparatus as recited in claim 1, wherein the sleeve is coupled with the golf cup.

5. The golf cup apparatus as recited in claim 1, wherein the sleeve is formed of extruded material.

6. The golf cup apparatus as recited in claim 1, wherein the golf cup comprises a metal golf cup including flag retention features therein;

the sleeve comprising a plastic cylinder defined in part by an outer surface; and the plastic cylinder disposed within the metal cup such that the outer surface of the plastic cylinder rests against the interior surface of the metal golf cup in an interference fit therebetween.

7. The golf cup apparatus as recited in claim 1, wherein the sleeve is severable.

8. A golf cup apparatus comprising:

a golf cup comprising a cylinder extending from a top surface to a bottom surface, the golf cup including a wall extending between the top surface and the bottom surface, the cup wall defined by an interior surface and an exterior surface;

a cup sleeve disposed within the golf cup, the sleeve comprising a cylinder having an open circular top end and an open circular bottom end and the cup sleeve abutting the interior surface of the golf cup without interfering with a golf ball dropping within the golf cup; and the sleeve includes a line of weakness; and wherein the cup sleeve extends from a first end to a second end and the line of weakness extends from the first end to the second end of the cup sleeve.

9. The golf cup apparatus as recited in claim 8, wherein the sleeve extends from the top surface of the golf cup to the bottom surface of the golf cup.

10. The golf cup apparatus as recited in claim 8, wherein the sleeve extends partially between the top surface and the bottom surface of the golf cup.

11. The golf cup apparatus as recited in claim 10, wherein a top portion of the sleeve is substantially aligned with the top surface of the golf cup.

12. The golf cup apparatus as recited in claim 8, wherein the cup sleeve is coupled with the golf cup.

13. A golf cup apparatus comprising:

a golf cup comprising a cylinder extending from a top surface to a bottom surface, the golf cup including a wall extending between the top surface and the bottom surface, the cup wall defined by an interior surface and an exterior surface;

a cup sleeve disposed within the golf cup, the sleeve comprising a cylinder having an open circular top end and an open circular bottom end and the cup sleeve abutting the interior surface of the golf cup without interfering with a golf ball dropping within the golf cup; and the sleeve includes a line of weakness; and;

wherein the cup sleeve extends from a first end to a second end and the line of weakness extends from the first end to the second end of the cup sleeve.

* * * * *